United States Patent [19]

Kato

[11] Patent Number: 4,967,619

[45] Date of Patent: Nov. 6, 1990

[54] MATERIAL FEEDING APPARATUS

[75] Inventor: Heizaburo Kato, Shizuoka, Japan

[73] Assignee: Sankyo Manufacturing Company, Ltd., Tokyo, Japan

[21] Appl. No.: 315,862

[22] Filed: Feb. 27, 1989

Related U.S. Application Data

[62] Division of Ser. No. 96,094, Sep. 14, 1987, Pat. No. 4,819,850.

[30] Foreign Application Priority Data

Sep. 22, 1986 [JP] Japan ..... 61-224297

[51] Int. Cl.[5] ..... F16H 21/44

[52] U.S. Cl. ..... 74/837; 74/104; 74/380; 74/600

[58] Field of Search ..... 74/104, 380, 600, 601, 74/837

[56] References Cited

U.S. PATENT DOCUMENTS

| | | | |
|---|---|---|---|
| 793,468 | 6/1905 | Phelps | 74/380 |
| 1,174,716 | 3/1916 | Haynes | 74/380 |
| 1,858,184 | 5/1932 | Buenger | 74/600 X |
| 3,118,318 | 1/1964 | Rauhut | 74/600 X |
| 3,557,639 | 1/1971 | Homstead | 74/600 X |
| 4,523,449 | 6/1985 | Moriyama et al. | 226/165 X |
| 4,552,294 | 11/1985 | Rotzler | 226/162 X |

FOREIGN PATENT DOCUMENTS

| | | | |
|---|---|---|---|
| 1250227 | 3/1968 | Fed. Rep. of Germany . | |
| 2051005 | 12/1972 | Fed. Rep. of Germany . | |
| 2158777 | 5/1973 | Fed. Rep. of Germany . | |
| 60-27549 | 8/1985 | Japan . | |
| 2105810 | 3/1983 | United Kingdom | 74/600 |

*Primary Examiner*—Allan D. Herrmann

*Attorney, Agent, or Firm*—Pollock, Vande Sande & Priddy

[57] ABSTRACT

An apparatus for converting an oscillatory motion to a linear sliding motion comprises a slide block provided for reciprocatory sliding movement along a linear path and an oscillating shaft. An oscillating arm is adopted to oscillate about the axis of the oscillating shaft. The oscillating arm connects said oscillating shaft to the slide block. An adjusting device is provided on the oscillating arm for adjusting a sliding stroke of the slide block with respect to an angle of rotation of the oscillating shaft. Also, a counting and indicating device is provided on the oscillating arm for counting and indicating an amount of sliding stroke of the slide block.

14 Claims, 18 Drawing Sheets

MATERIAL FEEDING APPARATUS

This is a divisional of Ser. No. 096,094, filed on Sept. 14, 1987 now U.S. Pat. No. 4,819,850.

BACKGROUND OF THE INVENTION

1. Field of the Invention

The present invention relates to an apparatus for intermittently feeding a predetermined amount or length of material such as a sheet or a rod to a working machine such as a press.

2. Description of the Prior Art

Such a material feeding apparatus has been known as having a first gripper device having a first fixed gripper and a first movable gripper which cooperate with each other in clamping and unclamping a material therebetween, and a second gripper device carried by a slide block reciprocatingly movable along a predetermined path of feed of the material having a second fixed gripper and a second movable gripper which cooperate with each other in clamping and unclamping the material therebetween, wherein the clamping and unclamping operation of the first and the second gripper devices and the sliding motion of the slide block are effected in a timed relation by a suitable mechanism incorporating a cam and an oscillation arm, thereby feeding the material along the predetermined path. This type of material feeding apparatus is disclosed, for example, in Japanese Utility Model Publication No. 27549/1985 (KOKAI 60-27549).

This known apparatus, however, involves the following problem due to the fact that both the first and the second movable grippers are controlled by means of a single oscillation arm operated by a single cam. Namely, it is difficult to design the apparatus to establish such a relation between the timing of operation of the first gripper device and the timing of operation of the second gripper device that both the first and the second gripper devices simultaneously grip the same piece of material at the beginning and at the end of each of the intermittent feeding cycles, thereby to attain a high precision of feed of the material.

SUMMARY OF THE INVENTION

Accordingly, an object of the present invention is to provide a material feeding apparatus which is capable of overcoming the above-described problems of the prior art.

To this end, according to one aspect of the present invention, there is provided a material feeding apparatus comprising: a first gripper device having a first fixed gripper and a first movable gripper for cooperation with each other in clamping and unclamping a material therebetween; a slide block provided for reciprocatory sliding movement along the path of feed of the material; a second gripper device arranged on the slide block opposite to the first gripper at a distance therefrom device and having a second fixed gripper and a second movable gripper for cooperation with each other in clamping and unclamping the material therebetween; a first gripper actuating device having a first actuating member movable between a clamping position where it holds the first movable gripper at a position near the first fixed gripper and an unclamping position where it allows the first movable gripper to be spaced apart from the first fixed gripper; a second gripper actuating device having a second actuating member movable between a clamping position where it holds the second movable gripper at a position near the second fixed gripper and an unclamping position where it allows the second movable gripper to be spaced apart from the second fixed gripper; and a cam device adapted to be driven continuously in one direction; the cam device having a first cam and a second cam which are operatively connected to the first actuating member and the second actuating member, respectively, thereby causing the first actuating member and the second actuating member to be moved between the respective clamping and unclamping positions, the cam means further having a third cam adapted to convert the continuous rotation of the cam device into an oscillatory motion of an oscillating shaft which is operatively connected to the slide block through an oscillating arm, so as to cause the reciprocatory sliding movement of the slide block in a predetermined timing with respect to the oscillatory motion of the oscillating shaft.

In the apparatus of the present invention, the first cam and the second cam are used for operating the first actuating member and the second actuating member thereby enabling the first gripper device and the second gripper device to clamp and unclamp the material, while the third cam operates the oscillation arm which in turn causes the movement of the slide block and the second gripper device carried by the slide block in the direction of feed of the material. The clamping and unclamping actions of the first gripper device and the second gripper device and the movement of the slide block are effected in a predetermined timed relation, whereby the material is fed intermittently precisely in a predetermined amount.

The above and other objects, features and advantages of the present invention will become clear from the following description of the preferred embodiment when the same is read in conjunction with the accompanying drawings.

BRIEF DESCRIPTION OF THE PREFERRED EMBODIMENTS

DESCRIPTION OF THE PREFERRED EMBODIMENT

Figure 1:
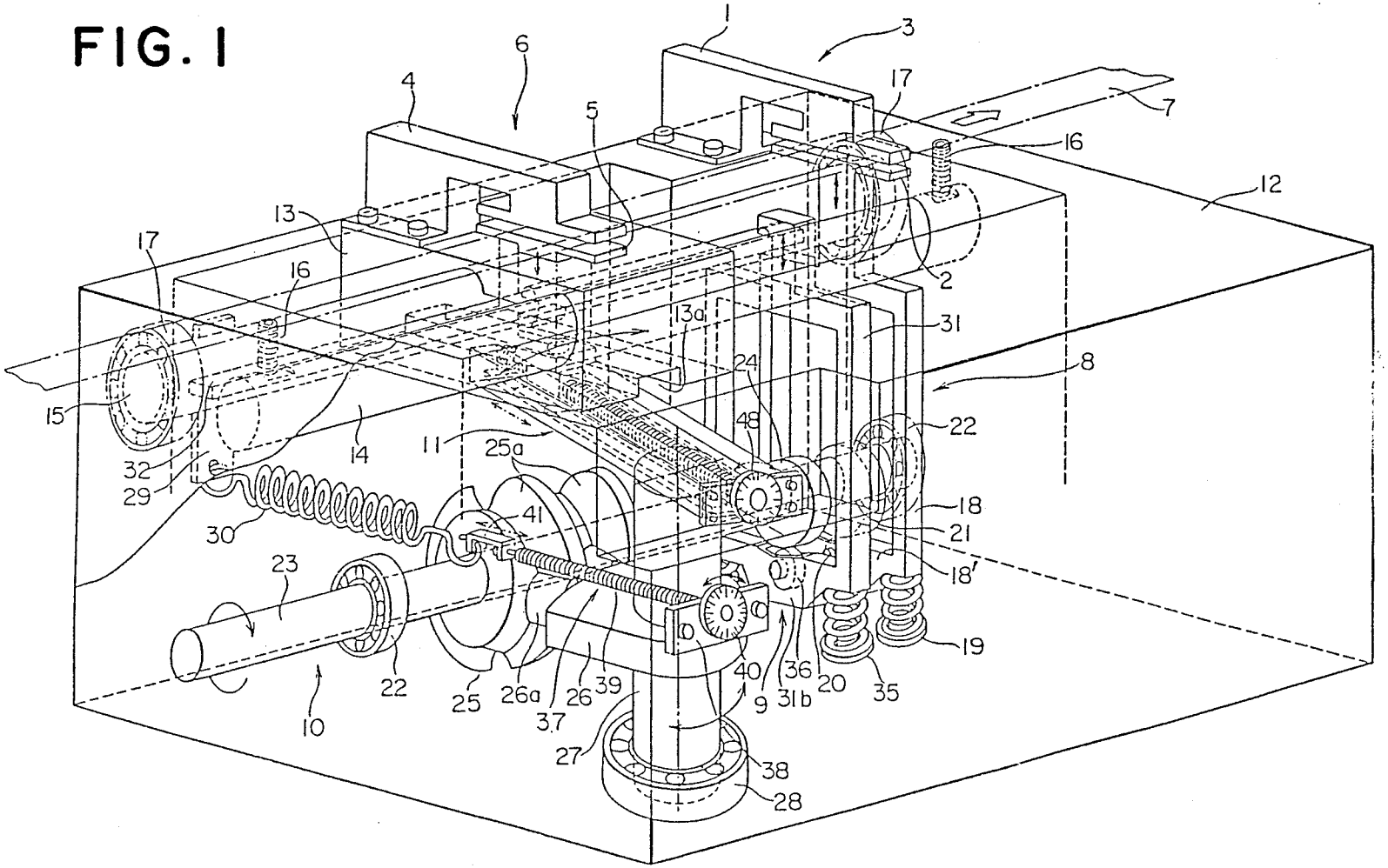
FIG. 1 is a schematic perspective view of an embodiment of a material feeding apparatus in accordance with the present invention.

Referring first to FIG. 1, an embodiment of the material feeding apparatus in accordance with the present invention has a first gripper device 3 including a first fixed gripper 1 and a first movable gripper 2, a second gripper device 6 including a second fixed gripper 4 and a second movable gripper 5, a first gripper actuating device 8 adapted for actuating the first gripper device 3 so as to cause a material to be clamped and unclamped by the first fixed gripper 1 and the first movable gripper 2, a second gripper actuating device 9 adapted for actuating the second gripper device 6 so as to cause a material to be clamped and unclamped by the second fixed gripper 4 and the second movable gripper 5, a cam device 10, and an oscillation arm 11.

This embodiment can be used for the purpose of feeding various types of material including a sheet material, a rod and so forth. In the following description, however, a sheet material will be specifically mentioned by way of example.

As will be seen from FIG. 1, the first fixed gripper 1 is fixed to a housing 12 of the material feeding apparatus, while the first movable gripper 2 is vertically movably disposed under the first fixed gripper 1. The second fixed gripper 4 is fixed to a slide block 13, while the second movable gripper 5 is movably mounted on the slide block 13. The slide block 13 is reciprocal and slidable in the direction of feed of a sheet material 7, along a fixed shaft 14 which is fixed at its both ends to the housing 12 by means of bolts 16 and extending through a bore formed in the slide block 13 and a rotary shaft 15 which is rotatably supported at its both ends by bearings on the housing 12 and extending through another bore formed in the slide block 13. As will be mentioned later, the rotary shaft 15 constitutes a part of the second gripper device 9.

The cam device 10 includes, as shown in FIG. 1, an input shaft 23 mounted on the housing 12 through the bearing 22 and continuously rotated in one direction, and first, second and third cams 21, 24 and 25 which are integrally carried by the input shaft 23. The first cam 21 and the second cam 24 are plate cams having cam contours on their peripheral surfaces, while the third cam 25 has the form of a roller gear cam having cam surfaces 25*a* on both sides of a tapered rib. The third cam 25 is adapted to cause an oscillatory motion of a turret 26 and an oscillating shaft 27 integral with the turret 26. More specifically, the turret 26 carries a plurality of cam followers 26*a* at its periphery and these cam followers make rolling contact with the cam surfaces 25*a*. As the third cam 25 is rotated together with the input shaft 23, the cam followers 26 follow the cam surfaces 25*a* thereby causing an oscillatory motion of the turret 26 and the oscillating shaft 27. A numeral 28 appearing in FIG. 1 denotes a bearing which supports the oscillating shaft 27.

Figure 2:
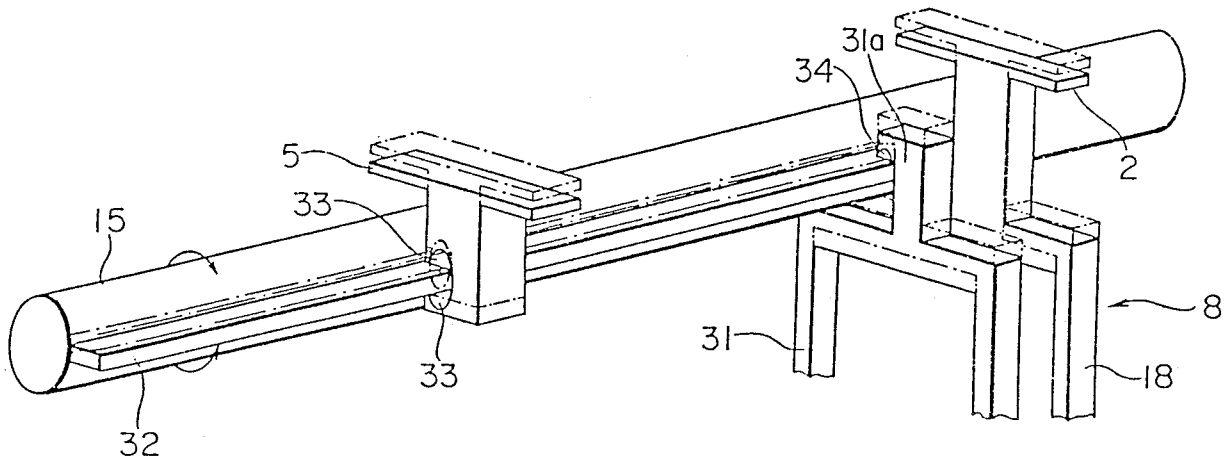
FIG. 2 is a partly enlarged perspective view of the material feeding apparatus as shown in FIG. 1.

As will be seen from FIGS. 1 and 2, the first gripper actuating device 8 has a first actuating member 18 having a frame-like form and integrally connected to the first movable gripper 2. The first actuating member 18 is normally urged upward by a spring 19, and has a lower frame portion 18′ provided with a cam follower 20 which is adapted to follow the cam contour of the first cam 21. As the input shaft 23 and, hence, the first cam 21 are continuously rotated, the first actuating member is moved through the mutual engagement between the first cam 21 and the cam follower 20, between an unclamping position where it has been lowered against the force of the spring 19 so as to move the first movable gripper 2 away from the first fixed gripper 1 thereby unclamping the sheet material 7 as shown in FIG. 1 and also by solid lines in FIG. 2 and a clamping position where it has been raised by the force of the spring 19 to bring the first movable gripper 2 closer to the first fixed gripper 1 thereby clamping the sheet material 7 as shown by chain lines in FIG. 2.

Referring to FIGS. 1 to 5, the second gripper actuating device 9 includes, in addition to the abovementioned rotary shaft 15, a spring 30 which urges the rotary shaft counterclockwise by acting on a plate 29 fitted on the ,rotary shaft 15, and a frame-like second actuating number 31. A rail-like actuating tab 32 projects from one side of the rotary shaft 15. As will be best seen from FIG. 2, upper and lower crescent-shaped tabs 33 are rotatably supported on a lower portion of the second movable gripper 5 and the actuating tab 32 is slidably carried by the second movable gripper 5 by being slidably held between these crescent-shaped tabs 33. Therefore, when the slide block 13 slides along the fixed shaft 14 and the rotary shaft 15 as explained before, the second gripper 5 is moved together with the slide block 13 so as to slide along the actuating tab. As is the case of the first actuating member 18, the second actuating member 31 is normally urged upward by a spring 35 (see FIG. 1), while the lower frame portion 31*b* is provided with a rolling cam follower 36 adapted for engagement with the second cam 24. The second actuating member 31 has a crescent-shaped member 34 rotatably mounted on the upper end thereof, and is provided with an engaging portion 31*a* (see FIG. 2) which engages with the upper face of the actuating member 32.

As the second cam 24 is continuously rotated together with the input shaft 23, the second actuating member 31 is moved to a lower position by the force produced by the mutual engagement between the second cam 24 and the cam follower 36 overcoming the force of the spring 35 and then to an upper position by the force of the spring 35.

As shown in FIG. 1 and also by solid lines in FIG. 2, when the second actuating member 31 is in the lower position, the second movable gripper 5 has been lowered away from the second fixed gripper 4 thereby unclamping the sheet material 7. Thus, the lower position may be referred to as unclamped positions. Conversely, when the second actuating member 31 is in the upper position as shown by chain line in FIG. 2, the second movable gripper has been moved by the second actuating member 31 to get closer to the second fixed gripper 4, thereby clamping the sheet material 7. Thus, the upper position can be referred to as "clamping position".

Figure 3:
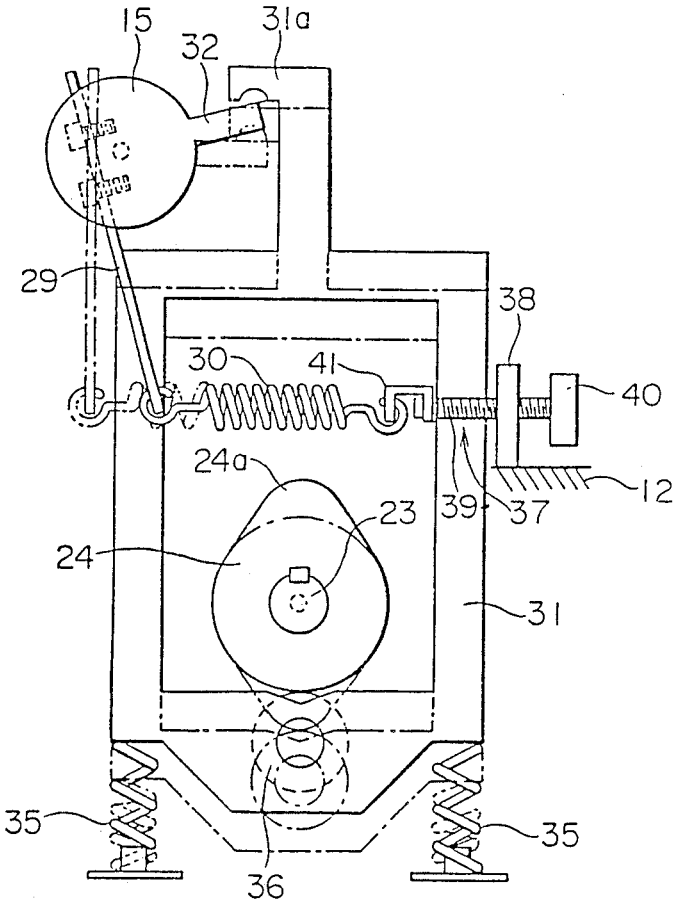
FIGS. 3 to 5 are illustrations of operation of the second gripper actuating device.
Figure 4:
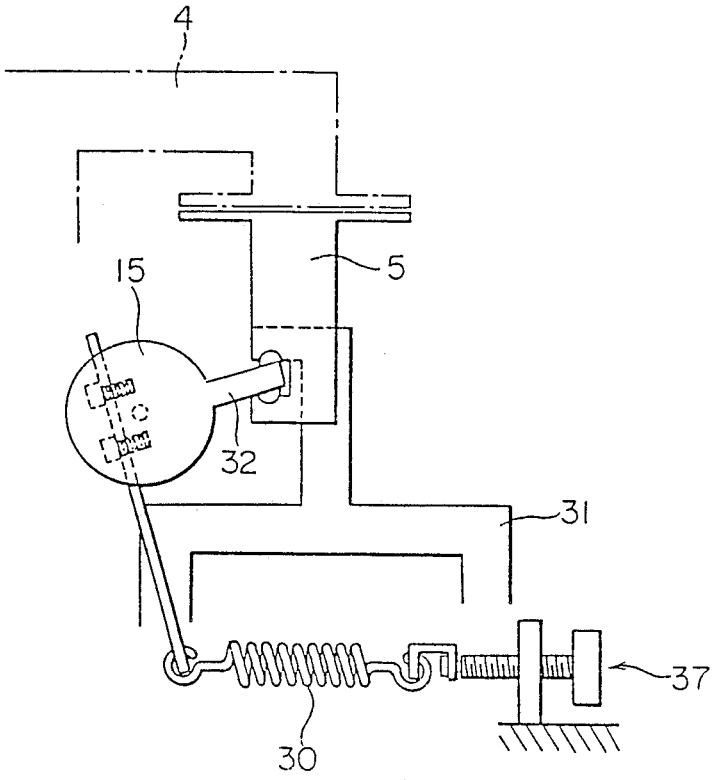
Figure 5:
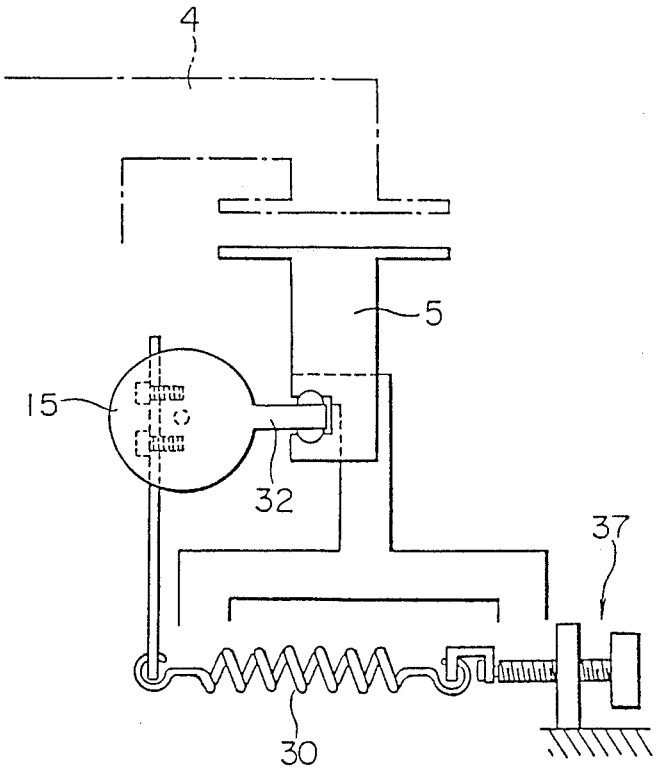

More specifically, as will be clearly seen from FIGS. 3 to 5, the second actuating member 31 is raised and held at the position shown by solid lines in FIG. 3 by the force of the spring 35 when the cam follower 36 is not pressed downward by the second cam 24. In this state, the engaging portion 31*a* of the second actuating member 31 also has been raised so that the rotary shaft 15 and the actuating member tab 32 are rotated counterclockwise by the spring 30 so as to be held at the position shown by solid lines in FIG. 3. In consequence, as shown in FIG. 4, the second movable gripper 5 is moved by the actuating tab 32 so as to get closer to the second fixed gripper, whereby the sheet material 7 is gripped by both grippers 4 and 5. However, when the second cam 24 is rotated from the position shown by solid line to the position shown by chain line in FIG. 3, the highest portion 24*a* of the cam 24 presses the cam follower 36 downward so that the second actuator 31 is lowered against the force of the spring 35 to the position shown by chain line in FIG. 3. During this operation, the engaging portion 31*a* presses the actuating tab 32 downward thereby causing the rotary shaft 15 clockwise against the force of the spring 30. In consequence, the actuating tab 32 drives the second movable gripper downward away from the second fixed gripper 4, thereby to unclamp the sheet material which has been clamped between both grippers 4 and 5.

As shown in FIGS. 1, 3, 4 and 5, the spring 30 is provided at its one end with a spring force adjusting device 37. The spring force adjusting device 37 has a plate 38 fixed to the outer surface of the housing 12, a screw rod 39 screwed to this plate 38 and extending inwardly therefrom, a rotary knob 40 fixed to the outer end of the screw rod 39 at a position on the outer surface of the plate 38 exposed to the outside of the housing 12, and a connecting member 51 through which the inner end of the screw rod 39 and the outer end of the spring 30 are connected to each other. The arrangement is such that, as the screw rod 39 is rotated by means of the knob 40, the connecting member 41 is moved in the direction of the axis of the spring 30, whereby the tension of the spring is adjusted.

As will be understood from the foregoing description taken in conjunction with FIGS. 3 and 4, the second movable gripper 5 is adapted to cooperate with the second fixed gripper 4 in clamping therebetween the sheet material, when raised by the force of the spring 30. It will be understood that the clamping force exerted by the second fixed gripper 4 and the second movable gripper 5 on the sheet material can be freely adjusted by varying the force of the spring 30. As will be explained later, the second gripper device 6 is adapted to move together with the slide block 13, with the sheet material clamped between the grippers 4 and 5 thereof. In order to ensure a high precision of feed of the sheet material without allowing any slip, therefore, it is preferred to adopt the above-described clamping force adjusting function. The rotary knob 40 is provided on the outer surface thereof with a scale which indicates the level of the clamping force applied to the sheet member.

The oscillating shaft 27 oscillatorily driven by the third cam 25 of the cam device 10 and the slide block 13 mentioned above are drivingly connected to each other by the oscillation arm 11. More specifically, the oscillation arm 11 has an arm member 42 provided at its outer end with a supporting plate 44 and fixed at its portion which is slightly spaced from the outer end to the oscillating shaft 27, a screw rod 43 extending through the central portion of a slot 42*a* in the longitudinal direction of the slot 42*a*, the slot 42*a* being formed in the arm member 42 and extending in the longitudinal direction of the arm member 42 and opened upward, an adjusting member 45 which is screwed to the screw rod 43 and slidably engaging with the slot 42*a* for sliding movement in the longitudinal direction of the slot 42*a*, and a slider 47 rotatably secured to an upper portion of the adjusting member 45 through a pin 46 and slidably engaging with a slot 13*a* formed in the underside of the slide block 13 so as to open downward, and extending in the direction perpendicular to the direction of feed of the sheet material. The outer end of the screw rod 43 is provided with a nonthreaded rod portion 43*a* which fixedly fits in a hole formed in the supporting plate 44 against any rotation and axial movement. A rotary knob 48 is fixed to the outer end of the rod 43*a*. The knob 48 is exposed to the outside of the housing 12 so as to be adjusted from the outside.

The oscillation arm 11 is adapted to oscillate as indicated by an arrow A about the axis of the oscillating shaft 27 when the oscillating shaft 27 oscillates. The oscillatory motion of the oscillation arm 11 causes the slider 47 to slide along the slot 13*a* while driving the slide block 13 to the left and right as viewed in FIG. 6 (see arrow A'), whereby the aforementioned sliding motion of the slide block 13 along the fixed shaft 14 and the rotary shaft 15 is conducted. A rotation of the rotary knob 48 and, hence, of the screw rod 43 as indicated by an arrow B in FIG. 6 causes the adjusting member 45 to move the screw rod 43 in the longitudinal direction. At the same time, the slider 47 moves together with the adjusting member 45. This in turn causes a change in the distance between the oscillating shaft 27 constituting the fulcrum of oscillation of the oscillation arm 11 and the slider 47 which engages with the slide block 13 and adapted to cause the slide block 13 to move to the left and right as viewed in FIG. 6. As will be described later, this change in the distance causes a change in the amount of feed of the sheet material per each cycle of the feeding operation. A scale indicative of the amount of feed of the sheet material per feeding cycle is provided on the outer surface of the rotary knob 48.

In operation, as the input shaft 23 of the cam device 10 is driven to rotate the first, second and the third cams 21, 24 and 25, the first movable gripper 2 of the first gripper device 3 and the second movable gripper 5 of the second gripper device 6 are operated in a later-mentioned timed relation so as to clamp and unclamp the sheet material. In addition, the second fixed gripper 4 and the second movable gripper 5 of the second gripper device 6 are moved along the path of feed of the sheet material together with the slide block 13 in a timed relation to the clamping and unclamping operation, thereby to feed the sheet material 7 along the path.

The timing of the clamping and unclamping operation and the feeding operation will be explained with reference to FIGS. 7A to 7F.

Figure 7A:
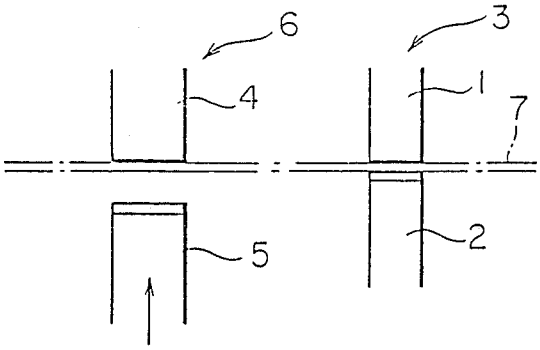
FIGS. 7A to 7F are illustrations of the relation between the operation of a first gripper device and the operation of a second gripper device.
Figure 7B:
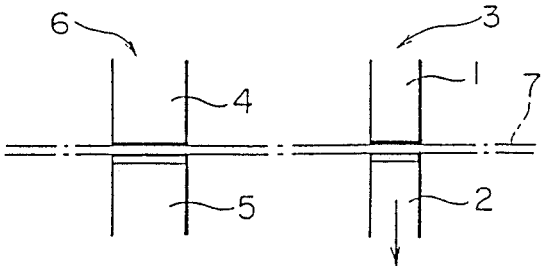
Figure 7C:
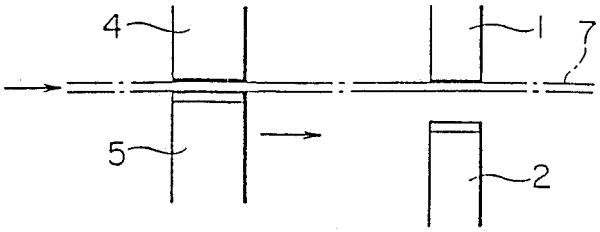
Figure 7D:
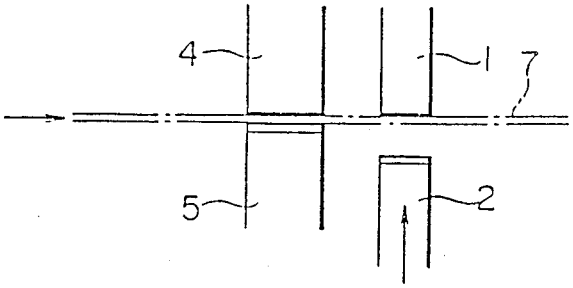
Figure 7E:
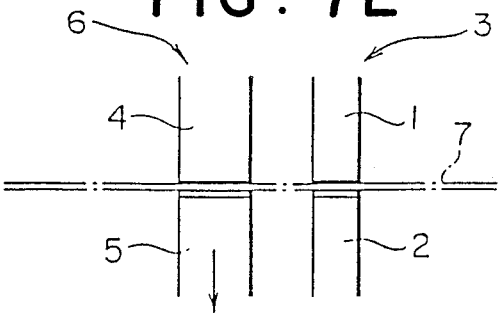
Figure 7F:
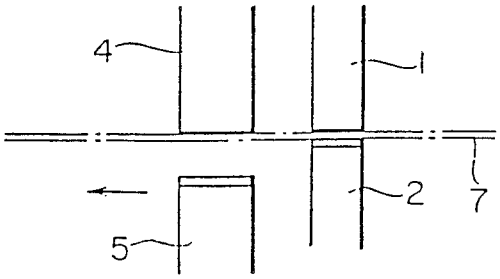

FIG. 7A shows the state in which the first movable gripper 2 has been raised to cooperate with the first fixed gripper 1 in clamping the sheet material 7 therebetween. In this state, however, the second movable gripper 5 is in the lower position where it is moved apart from the second fixed gripper 4 so as not to clamp the sheet material 7. As the input shaft 23 further rotates, the second movable gripper 5 is raised to become to clamp the sheet material 7 together with the second fixed gripper 4, as shown in FIG. 7B and, thereafter, the first movable gripper 2 is lowered to unclamp the sheet material as shown in FIG. 7C. Then, the second gripper device 6 with its movable and fixed grippers 5 and 4 clamping the sheet material 7 therebetween is moved as shown in FIG. 7D, thereby feeding the sheet material 7 by the same amount as the travel of the second gripper device 6. Immediately after the completion of the feed of the sheet material, the first movable gripper 2 is raised to clamp the sheet material 7 as shown in FIG. 7E and, thereafter, the second movable gripper 5 is lowered to release and unclamp the sheet material 7 as shown in FIG. 7F. Then, the second gripper device 6 including the fixed and movable grippers 4 and 5 is moved backward, i.e., in the direction opposite to the feeding direction, thus resuming the state as shown in FIG. 7A. This operation is cyclically repeated as long as the input shaft 23 continues to rotate, so that the sheet material 7 is fed intermittently precisely in a constant amount or length.

Clearly, the clamping and unclamping operation and the feeding operation in the timed relations described above can be attained by suitably designing the phase and contour of the first, second and third cams 21, 24 and 25 of the cam device 10. As will be understood from the foregoing description taken in conjunction with FIGS. 7A to 7F, the sheet material 7 is never freed throughout the period of operation but is always clamped by at least one of the first and the second gripper devices 3 and 6. Namely, in the state shown in FIG. 7D in which the feed of the sheet material 7 is just completed, the downward movement of the second movable gripper 5 is not commenced until the first movable gripper 2 is raised to the clamping position as shown in FIG. 7E. Similarly, in the state shown in FIG. 7A preparing for the feed of the sheet material, the downward movement of the first movable gripper 2 is not commenced until the second movable gripper 5 is raised to the clamping position as shown in FIG. 7B. In other words, there is a short period in which the sheet material 7 is clamped both by the first and the second gripper devices 3 and 4, at the beginning and end portions of each feeding cycle, as shown in FIGS. 7A and 7B. This prevents any over-feed due to, for example, inertia of the sheet material 7, thereby ensuring a high degree of precision in the feed of the sheet material 7. In the described embodiment, the first movable gripper 2 is actuated by the first cam 21 through the first gripper actuating device 8, while the second movable gripper 5 is actuated by the second cam 24 through the second gripper actuating device 9. Since the first and the second movable grippers 2 and 5 are actuated by different actuating systems, it is very easy to design various parts of the material feeding apparatus in such a manner as to enable all parts of the apparatus to operate in the described timed relations.

In the embodiment shown in FIG. 1, there is no means for guiding the movement of the sheet material 7 between the second gripper device 6 and the first gripper device 3. In order to prevent any buckling or winding of the sheet material 7 which may be caused during the convey of the sheet material between the positions of the gripper device which supports and guides the sheet material 7 is provided along the path of feed between the positions of the second gripper device 6 and the first gripper device 3.

Figure 8:
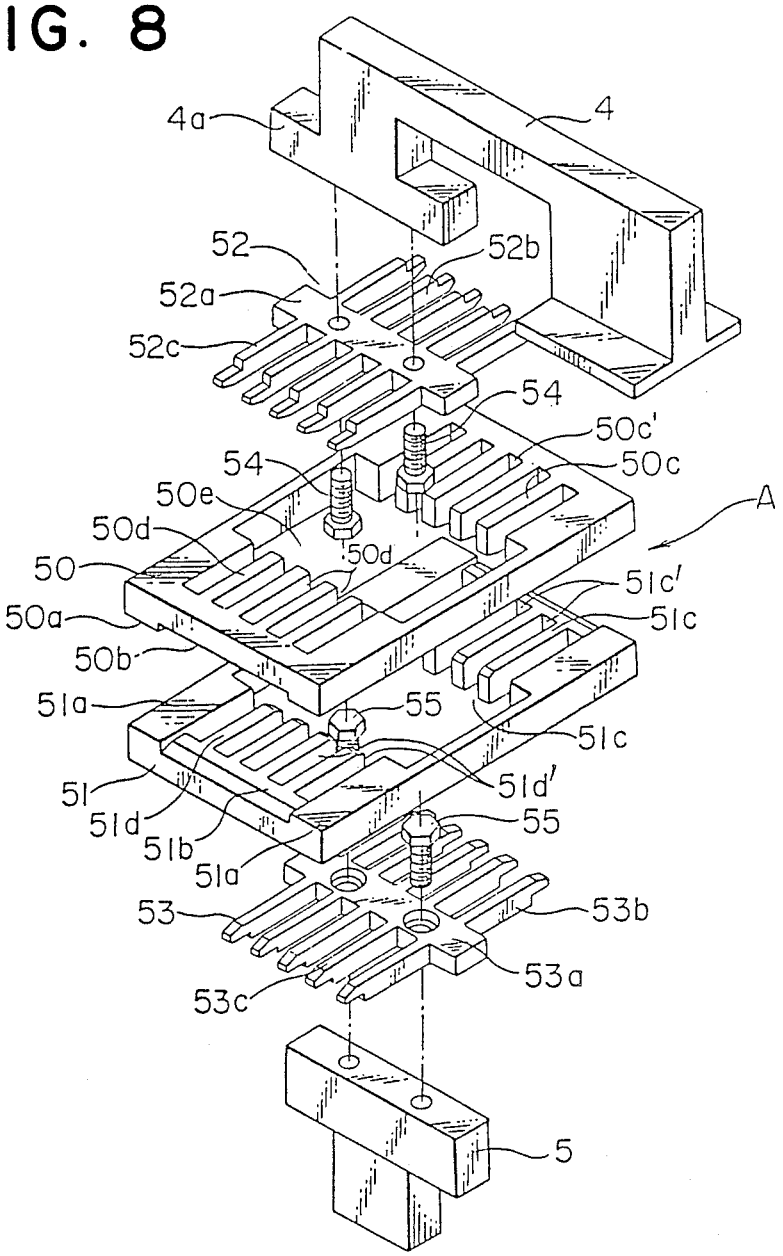
FIG. 8 is an exploded perspective view showing a guide device for guiding the movement of a material and a grip member used together with the guide device.

An example of such a guiding device will be described hereinunder with reference to FIGS. 8 and 9. The guiding device includes an upper guide 50 positioned under the second fixed gripper 4 and extending in the direction of feed of the sheet material over a predetermined length, and a lower guide 51 positioned above the second movable gripper 5 and extending over the same length as the upper guide 50 opposite the latter. These guides 50 and 51 are fixed to the housing 12 (see FIG. 1) in such a manner that the lower surface 50*a* of the upper guide 50 and the upper surface 51*a* of the lower guide 51 are adjoined to each other. The lower surface 50*a* of the upper guide 50 and the upper surface 51*a* of the lower guide 51 are provided with step surface 50*b* and 51*b*, respectively. The sheet material 7 is fed through the gap between the step surfaces 50*b* and 51*b* of the upper and lower guides 50 and 51 as indicated by an arrow A in FIG. 8.

The upper guide 50 is provided with groups of sawteeth-like projections 50*c* and 50*d* at its upstream and downstream ends as viewed in the direction of feed of the sheet material 7. The projections in the group 50*c* and the projections in the group 50*d* are disposed opposite each other in the direction of feed. The gaps 50′ between adjacent projections of the group 50*c*, the gaps 50*d*′ between adjacent projections of the group 50*d* and the gap 50*e* between both groups 50*c* and 50*d* of projections penetrate the thickness of the upper guide 50. The lower guide 51 also is provided with similar groups of sawteeth-like projections 51*c* and 51*d* which are vertically aligned with the groups 50*c* and 50*d* of the upper guide 50. The gaps 51*c*′ between adjacent projections of the group 51*c*, the gaps 51*d*′ between adjacent projections of the group 51*d* and the gap 51*e* between both groups 51*c* and 51*d* of projections penetrate the thickness of the upper guide 51.

An upper grip member 52 is secured by means of bolts 54 to the lower surface of the grip portion 4*a* of the second fixed gripper 4. Similarly, a lower grip member 53 is secured by means of bolts 55 to the upper surface of the second movable gripper 5. The upper grip member 52 has a stem portion 52*a* having a width smaller than the length of the gap 50*e* in the upper guide 50 and a plurality of saw-teeth-like projections 52*b* and 52*c* which project from the stem portion 52*a* towards the upstream and downstream sides so as to be received in the above-mentioned gaps 50*c*′ and 50*d*′. When the upper grip member 52 is attached to the grip portion 4*a*, the stem portion 52*a* is positioned within the gap 50*e* and the lower surface of the upper grip member 52 is flush with the lower surface of the upper guide 50. The lower grip member 53 is provided with a stem portion 53*a* and saw-teeth projections 53*d*, 53*c* which are similar to those of the stem portion 52*a* and the saw-teeth-like projections 52*b*, 52*c* of the upper grip member 52.

As explained before in connection with FIGS. 1 to 7, the second movable gripper 5 is adapted to move up and down so as to clamp and unclamp the sheet material 7. When the second movable gripper 5 is in the raised position, the stem portion 53*a* of the lower grip member 53 is positioned in the gap 51*e* and the upper surface of the lower grip member 53 is flush with the upper surface 51*a* of the lower guide 51.

Figure 9A:
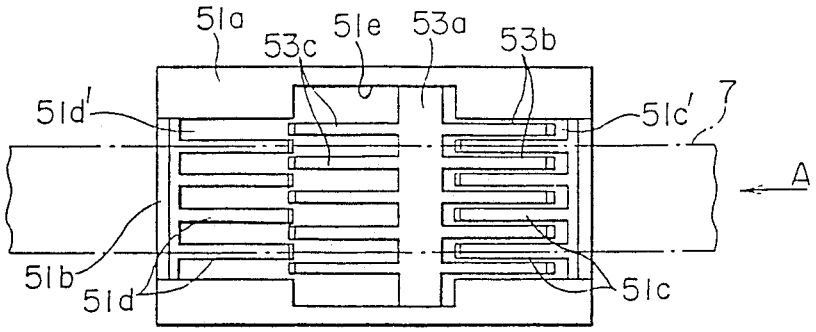
FIGS. 9A to 9C are illustrations of operational relation between the parts shown in FIG. 8.
Figure 9B:
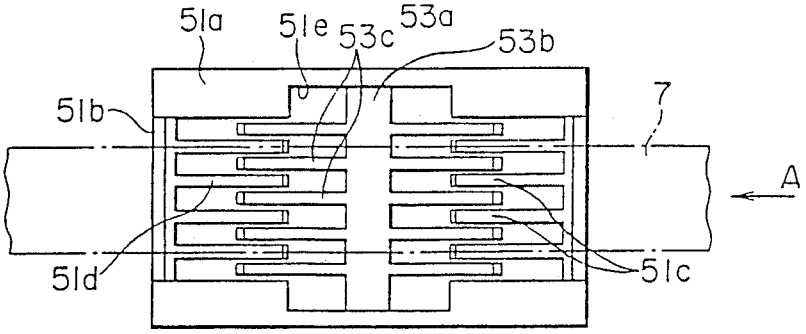
Figure 9C:
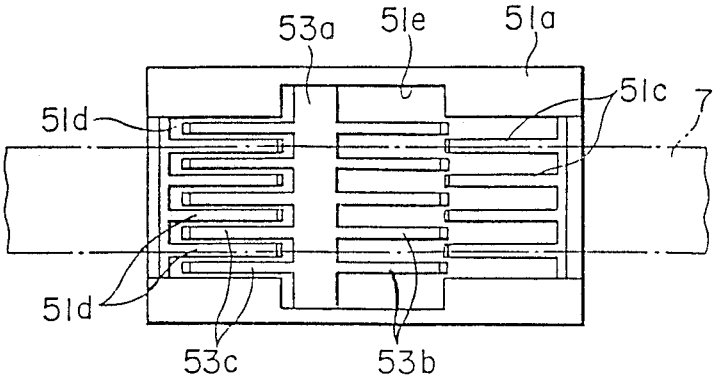

FIGS. 9A to 9C show the positional relationship between the lower guide 51 and the lower grip member 53 as viewed from the upper surface 51*a* of the lower guide 51 in the assembly formed from the members explained in connection with FIG. 8. In the operation of this assembly, when the second movable gripper 5 is raised, the sheet material 7 which has been introduced into the gap between the step surfaces 50*b* and 51*b* of the upper and lower guides 50 and 51 is clamped between the upper grip member 52 and the lower grip member 53. FIG. 9A shows the positional relationship between the lower guide 51 and the lower grip member 53 in this state. As will be seen from FIG. 9A, in this clamping state, the stem portion 53*a* of the lower grip member 53 is positioned near the upstream end of the gap 51*e* in the lower guide 51 while the saw-teeth-like projections 53*b* are located within the gaps 51*c*'. As the second fixed gripper 4 and the second movable gripper 5 are moved in the direction of feed indicated by the arrow A from the position shown in FIG. 9A, the lower grip member 53 is progressively moved in the sheet material feeding direction with respect to the lower guide 51 as shown in FIG. 9B. Then, as the second gripper device 6 further moves, the stem portion 53*a* is moved to the downstream end of the gap 51*e* and the saw-teeth-like projections 53*c* are brought into the gaps 51*d*' as shown in FIG. 9C, thus completing one cycle of the sheet material feeding operation.

As will be seen from FIGS. 9A to 9C, the lower grip member 53 can move smoothly in the guide 51 without being interfered by any portion of the lower guide 51. During the movement of the lower grip member 53 from the position shown in FIG. 9A to the position shown in FIG. 9C, the lower surface of the portion of the sheet material 7 which is not clamped between the grip members 52 and 53 are stably supported by the upper surface 51*b* of the lower guide 51 including the upper surfaces of the saw-teeth-like projections 51*c* and 51*d*, so that the sheet material 7 can be fed stably and smoothly.

The upper grip member 52 and the lower grip member 53, as well as the upper guide 50 and the lower guide 51, are vertically aligned with each other so that both grip members 52 and 53 are moved as a unit with each other in the feeding direction thereby to feed the sheet material 7.

It will be clear to those skilled in the art that the relationship between the upper guide 50 and the upper grip member 52 is materially the same as that between the lower guide 51 and the lower grip member 53 explained in connection with FIGS. 9A to 9C.

Figure 10:
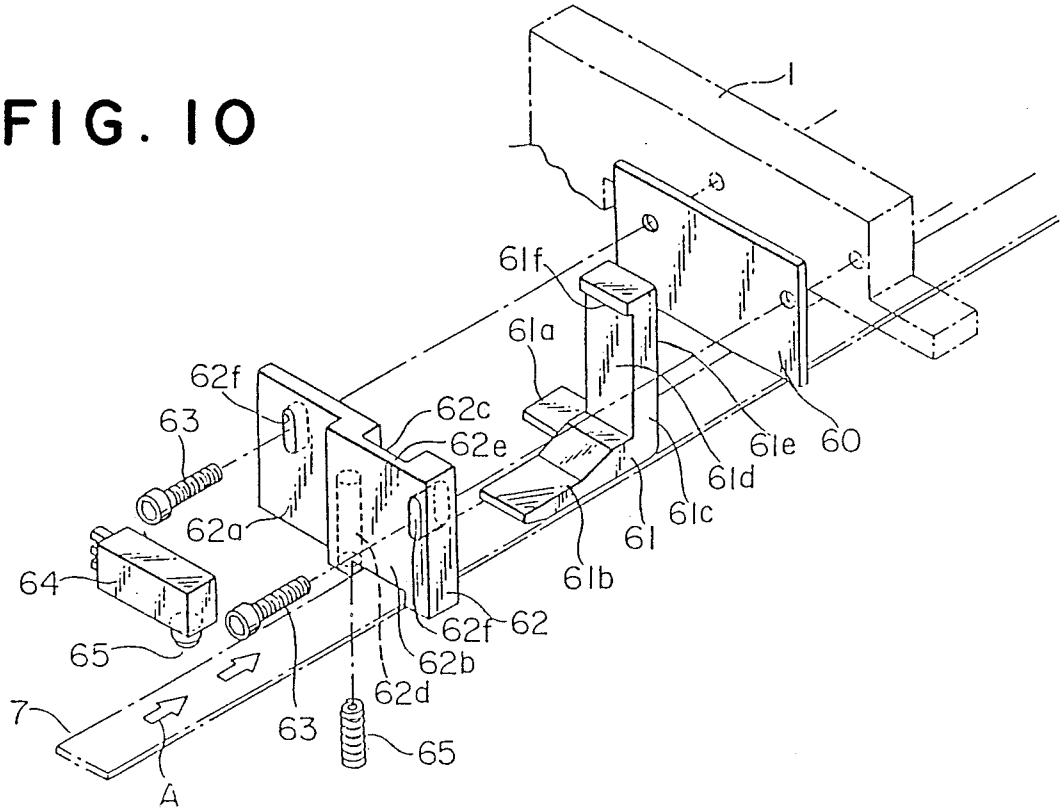
FIG. 10 is an exploded perspective view illustrating a material buckling detecting device.
Figure 11A:
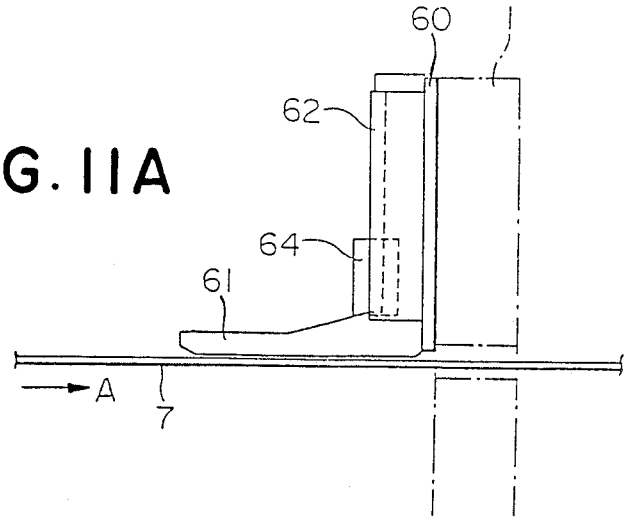
FIGS. 11A and 11B are side elevational views illustrating the operation of the buckling detecting device.
Figure 11B:
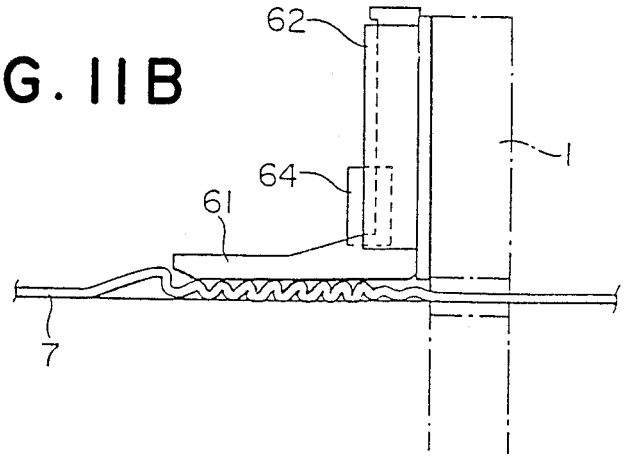

The material feeding apparatus described hereinbefore with reference to FIG. 1 and other Figures may be provided with a material buckling detecting device as shown in FIGS. 10 and 11A and 11B. The material buckling detecting device has a supporting plate 60, a guide member 61 including a substantially L-shaped main portion 61*c* and a tabular portion 61*a* projecting laterally from a lower portion of the main part 61*c*, the lower surface 61*b* of the guide member 61 being slightly above the upper surface of the sheet material 7 and presenting a guide surface which suppresses any fluttering tendency of the sheet material 7 thereby to guide the latter, a retaining member 62 for pressing and retaining the guide member 61, and a limit switch 64. The retaining member 62 has a main part 62*b* and a tabular portion 62*a* extending laterally from the main part 62*a*. Opposing recesses 61*d* and 62*c* are formed in the opposing surfaces of the main part 61*c* of the guide member 61 and the main part 62*b* of the retaining member 62. The guide member 61, retaining member 62 and the supporting plate 60 are fastened by means of bolts 63 to the front surface, i.e., the upstream surface, of the first fixed gripper 1, in such a manner as to allow the guide member 61 to move up and down, with the recess 61*d* and the rear surface 62*e* of the guide member 61 engaging with the recess 62*c* in the retaining member 62 and the surface of the supporting plate 60, respectively.

When the retaining member 62, guide member 61 and the supporting member 60 are assembled together in the described manner, a spring 65 received in a bore 62*d* in the retaining member 62 contacts at its lower end with the tabular portions 61*a* of the guide member 61 thereby to press the same downward, whereby the top portion 61*f* of the recess 61*d* of the guide member 61 is pressed onto the top 62*e* of the main part 62*b* of the retaining member 62, this maintaining a suitable clearance between the bottom surface 61*b* of the guide member 61 and the surface of the sheet material 7. The fastening bolts 63 are received in elongated holes 62*f* formed in the retaining member 62 so that the vertical position of the retaining member 62 is adjustable thereby allowing the clearance between the bottom surface 61*b* and the sheet material 7 to be suitably varied in accordance with a change in the thickness of the sheet material 7. The limit switch 64 is fixed to the tabular portion 62*a* of the retaining member 62 in such a manner that the sensing portion 65 of the limit switch 64 is positioned slightly above the tabular portion 61*a* in normal condition.

When there is no buckling in the sheet material 7 as shown in FIG. 11A, the sensing portion 65 of the limit switch 64 is sufficiently spaced from the tabular portion 61*a* of the guide member 61 so that the feed of the sheet material is conducted without interruption. However, when a buckling of the sheet material 7 takes place as shown in FIG. 1B, the ridge of the buckled sheet material 7 raises the guide member 61 so as to bring the tabular portion 61*a* into contact with the sensing portion 65 thereby actuating the limit switch 64. The limit switch 64 then produces a signal for stopping the feeding of the tabular member.

Although in the foregoing description of the preferred embodiment a sheet-like material 7 is specifically mentioned as the material fed by the apparatus of the invention. This, however, is only illustrative and the invention is applicable equally well to other types of materials such as a rod, as will be clear to those skilled in the art. Thus, the apparatus shown in FIGS. 1 to 7A–7F can be directly used for the purpose of feeding a rod material. When the apparatus is used for the purpose of feeding a rod material, however, it is preferred that opposing semi-cylindrical grooves are formed in the lower surface of the first fixed gripper 1 and the upper surface of the first movable gripper 2, as well as in the lower surface of the second fixed gripper 4 and in the upper surface of the second movable gripper 5, thereby facilitating the clamping of the rod member. The same applies also to the arrangement shown in FIGS. 8 and 9A–9B. Thus, the apparatus shown in FIGS. 1 to 9A–9C can be used for various types of material which can be clamped and unclamped by the first and the second gripper devices 3 and 6. Similarly, the arrangement shown in FIGS. 10 and 11A, 11B can be used for any material which can operate the limit switch 64 by upwardly urging the guide member 61 when buckled or otherwise deformed.

Figure 12:
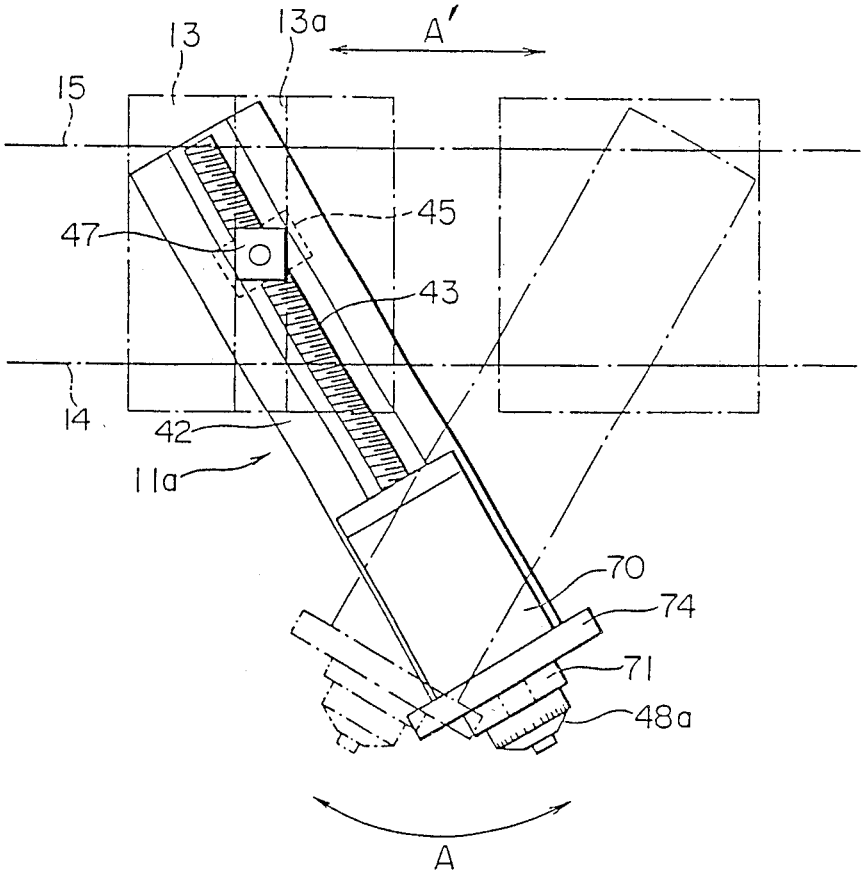
FIG. 12 is a top plan view illustrating a modification of the oscillation arm shown in FIGS. 1 and 6.
Figure 13:
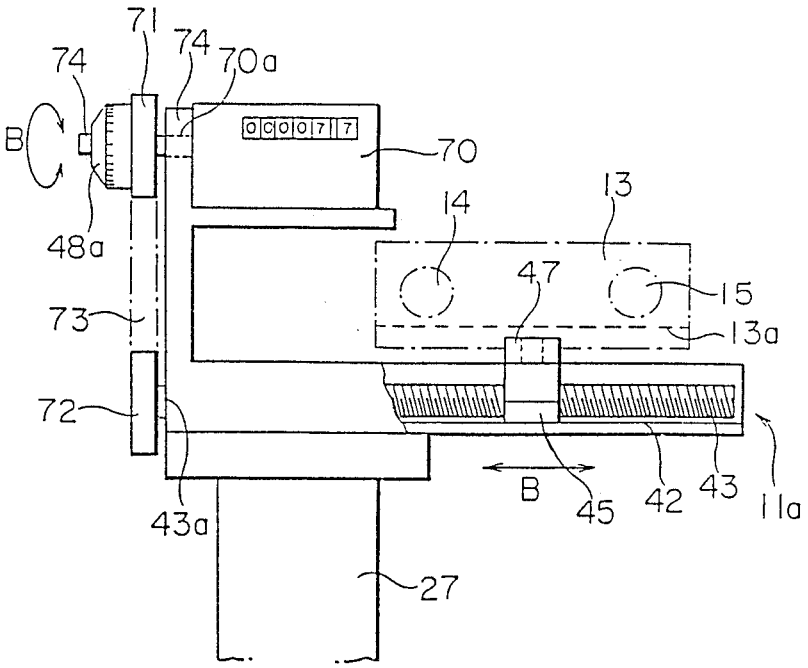
FIG. 13 is a right-side end view of the oscillation arm shown in FIG. 12.

FIGS. 12 and 13 show a modification of the oscillation arm 11 explained before in connection with FIGS. 1 and 6. The oscillation arm shown in FIGS. 12 and 13 has a function of counting and indicating the amount A' of sliding stroke of the slide block 13, in addition to the function performed by the oscillation arm 11 of enabling the adjustment of the sliding stroke A' of the slide block 13 with respect to the angle A of rotation of the oscillating shaft 27.

More specifically, the modification of the oscillation arm 11, denoted by the numeral 11*a*, has a supporting member 74 formed integrally with an upper portion of the left end of an arm main part 42 as shown in FIG. 13. The supporting member 74 supports a counter 70. A pulley 71 is fixed to the portion of the input shaft 70*a* extending from the counter 70. Another pulley 72 is fixed to a non-threaded rod portion 43*a* on the end of the screw rod 43. A belt 73 is stretched between these pulleys 71 and 72. A rotational knob 48*a* is fixed to the portion of the input shaft 70*a* projecting outward from the pulley 71. Other portions of the oscillation arm 11*a* shown in FIGS. 12 and 13 are materially the same as those of the oscillation arm 11 explained before in connection with FIGS. 1 and 6. Thus, the same reference numerals are used in FIGS. 12 and 13 to denote the same parts or members as those appearing in FIGS. 1 and 6.

In the operation of the oscillation arm 11*a* shown in FIGS. 12 and 13, as the rotary knob 48*a* is rotated, the screw rod 43 is rotated through the pulley 71, belt 73 and the pulley 72 so that the sliding stroke A' with respect to the oscillation angle A is changed and, at the same time, the sliding stroke A' is digitally indicated by the counter 70. The arrangement shown in FIGS. 12 and 13, however, suffers from a disadvantage in that, since the rotational knob 48*a* and the counter 70 are made to oscillate together with the oscillating shaft 27 and the arm main part 42, it is rather difficult to manipulate the knob 48*a* and to read the value indicated by the counter.

Figure 6:
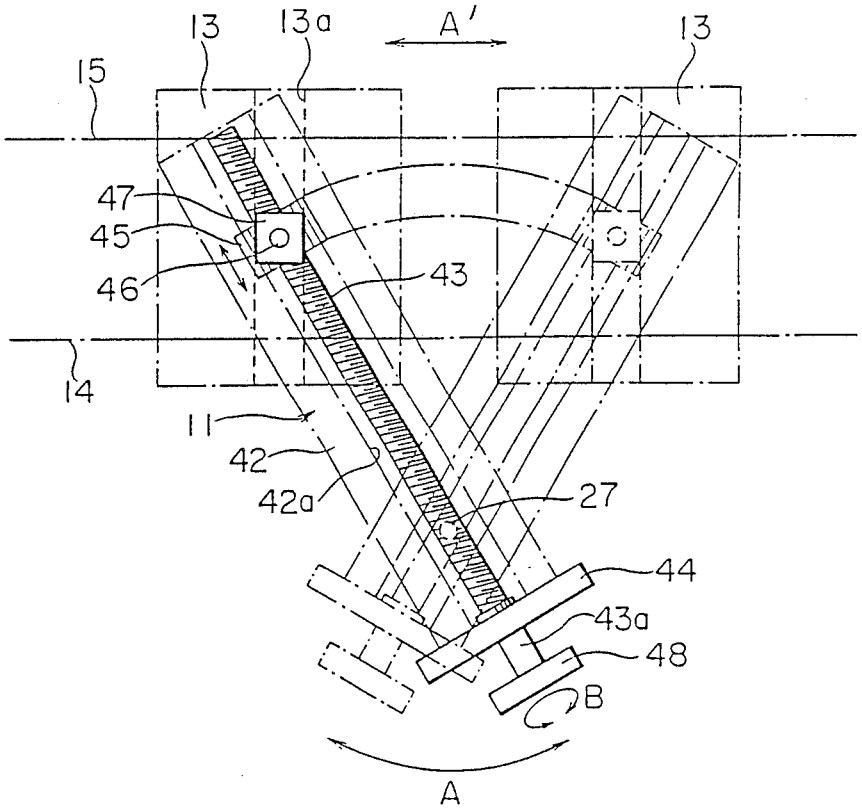
FIG. 6 is a top plan view illustrating the construction and operation of an oscillation arm.
Figure 14:
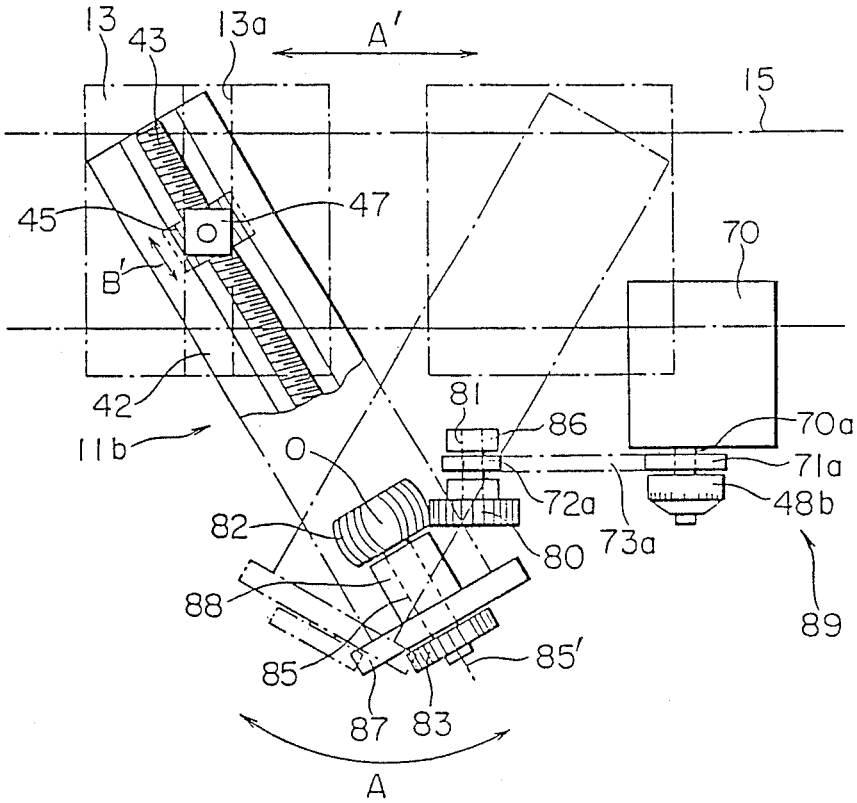
FIG. 14 is a top plan view illustrating another modification of the oscillation arm shown in FIGS. 1 and 6.
Figure 15:
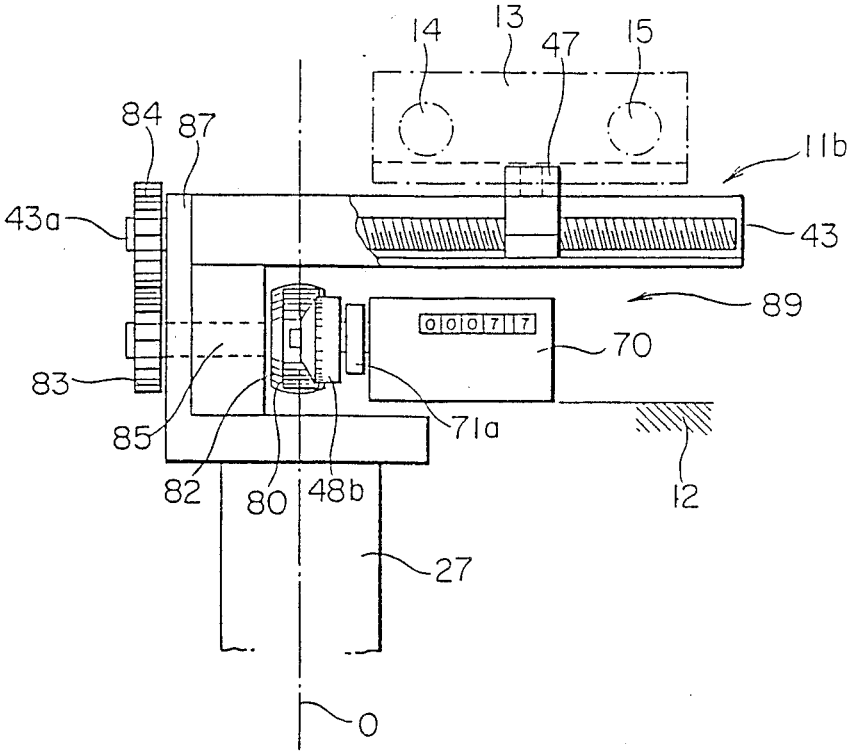
FIG. 15 is a right-side end view of the oscillation arm shown in FIG. 14.

FIGS. 14 and 15 show another modification of the oscillation arm 11 shown in FIGS. 1 and 6. This modification, denoted by a numeral 11*b*, has an indicating mechanism 89 capable of indicating the sliding stroke A' of the slide block 13. The indicating mechanism 89 is installed such that it is restrained from oscillating together with the oscillation arm 11*b*. More specifically, in the arrangement shown in FIGS. 14 and 15, a counter 70 and a supporting member 86 are fixed to a suitable portion of the housing 12. A pulley 71*a* is fixed to the input shaft 70*a* of the counter 70, while another pulley 72*a* is fixed to a shaft 81 which is rotatably carried by the supporting member 86 and provided with a spur gear 80 fixed to the outer end thereof. A belt 73*a* is stretched between these pulleys. A rotational knob 48*b* is fixed to the outer end of the input shaft 71*a*. A supporting member 88 is fixed to the inner side of the bracket 87 fixed to the oscillating shaft 27. A spherical gear 82 and a spur gear 83 are fixed, respectively, to the inner and the outer ends of a shaft 85 which is rotatably supported by the supporting member 88 and extending in parallel with the screw rod 43 through the supporting member 88 and the bracket 87.

The spherical gear 82 and the spur gear 83 engage with a spur gear 80 and a spur gear 84, respectively. The spur gear 84 is fixed to the outer end of the non-threaded rod portion on the outer end of the screw rod 43. The arrangement is such that, the spherical gear 82 is oscillated about the axis O of the oscillating shaft 27 as indicated by the arrow A together with the oscillating shaft 27, bracket 87, oscillation arm 11*b*, shaft 85, ,spur gears 84, 83 and other associated parts. The spherical gear 82 has gear teeth which are so arcuately formed that, during the oscillatory motion of the spherical gear 82, they are kept in engagement with the spur gear 80 so as to enable the spherical gear 82 to oscillate around the spur gear 80 and that, when the spur gear 80 is rotated as a unit with the shaft 81, it enables the spherical gear 82 to rotate about the axis 85' of the shaft 85. Other portions of the arrangement shown in FIGS. 14 and 15 are materially the same as those in the oscillation arm 11 explained before in connection with FIGS. 1 and 6 and, therefore, the same reference numerals are used in FIGS .14 and 15 to denote the same parts or members as those appearing in FIGS. 1 and 6.

The operation of the arrangement shown in FIGS. 14 and 15 is as follows. As the knob 48*b* is rotated, the spherical gear 82 is rotated through the pulley 71*a*, belt 73, pulley 72*a*, shaft 81 and the spur gear 80 and the rotation of the spherical gear 82 is transmitted through the shaft 85 and the spur gears 83 and 84 to the screw rod 43 to rotate the latter, whereby the sliding stroke A' of the slide block 13 with respect to the oscillation angle A of the oscillating shaft 27 is changed. At the same time, the input shaft 70*a* is rotated in accordance with the rotation of the knob 48*b* so that the sliding stroke A' is digitally indicated on the counter 70.

It will be seen that the counter 70 and the rotary knob 48*b* are kept still even during oscillation of the oscillation arm 11*b*. The counter therefore can be read easily and the rotary knob 48*a* can easily be rotated even during the oscillation of the oscillation arm 11*b*, i.e., during the feed of the material.

In the arrangement shown in FIGS. 14 and 15, it is not essential that the rotational knob 48*b* is fixed to the input shaft 70*a* of the counter 70. For instance, the arrangement shown in FIGS. 14 and 15 may be modified such that the shaft 81 is extended through the spur gear 80 to the lower side of the spur gear 80 as viewed in FIG. 14 and the rotational knob 48*b* is fixed to the thus projected lower end of the shaft 81. It will also be understood that the rotational knob 48*a* shown in FIGS. 12 and 13 need not be attached to the input shaft 70*a*. For instance, the arrangement shown in FIGS. 12 and 13 may be modified such that the rod portion 43*a* of the screw rod 43 is extended to the outer side, i.e., to the left side as viewed in FIG. 13, of the pulley 72 and the rotational knob 48*a* is attached to the thus extended portion of the rod portion 43*a*.

It is also to be understood that the buckling detecting device shown in FIGS. 10 and 11, the arrangement shown in FIGS. 12 and 13, and the arrangement shown in FIGS. 14 and 15 are independently applicable to various types of apparatus other than that shown in FIG. 1. More specifically, the buckling detecting device shown in FIGS. 10 and 11 may be used in various types of apparatus which requires a feed of a material with a function for detecting any buckling or other deformation of the material at a position selected along the path feed of the material. On the other hand, the arrangements shown in FIGS. 12 and 13 and FIGS. 14 and 15 may be employed in various types of apparatus which require transformation of an oscillatory motion of an oscillating shaft to a reciprocal linear sliding motion of a block through an arm.

For instance, the arrangements shown in FIGS. 12 to 15 may be modified, by additional provision of an attachment suitable for feeding a rod to the slide block 13, so as to have functions of adjusting and indicating the length of feed of a rod material.

Figure 16A:
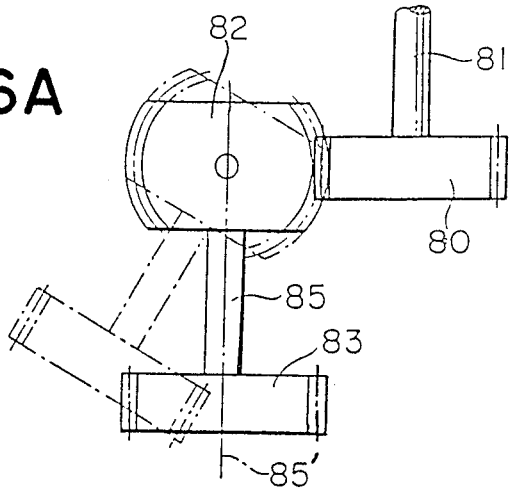
FIG. 16A is an enlarged illustration showing a spherical gear incorporated in the oscillation arm shown in FIGS. 14 and 15 and the relationship between the center of oscillation of the oscillation arm and the spur gear engaging with the spherical gear.
Figure 17A:
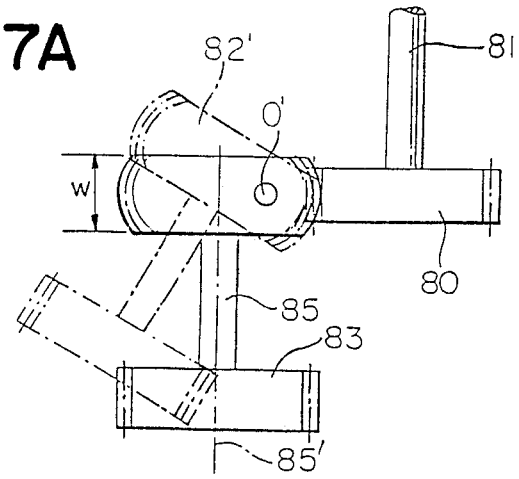
FIG. 17A is an illustration of a modification of the arrangement shown in FIG. 16A.

FIG. 16A shows, in a greater scale, the relationship between the spur gear 80 and the spherical gear 82 in the arrangement shown in FIGS. 14 and 15. As will be seen from this Figure, the distance between the axis of the oscillation of the oscillating shaft 27, i.e., the center O of oscillation of the spherical gear 82, and the axis of rotation of the spur gear 80 is equal to the distance between the axis 85' of rotation of the spherical gear 82 and the axis of rotation of the spur gear 80. FIG. 17A shows a modification in which the positional relationship between the oscillating shaft 27 and the parts such as the spherical gear 82, shaft 85 and the spur gear 83 in the arrangement shown in FIGS. 14 and 15 are so modified that the position of the axis of oscillation of the oscillating shaft 27, i.e., the center O of oscillation of the spherical gear, is moved to a position O' closer to the axis of rotation of the spur gear 80, without causing any change in the distance between the axis 85' of rotation of the spherical gear and the axis of rotation of the spur gear 80. According to the arrangement shown in FIG. 17A, it is possible to use a spherical gear 82' having a width w smaller than that of the spherical gear 82, on condition that the maximum angle of oscillation about the center of oscillation O' is equal to the maximum angle of oscillation about the center O in the arrangement shown in FIG. 16A. In addition, the arrangement shown in FIG. 17A effectively reduces the wear of the teeth of the spherical gear 82' and the spur gear 80 during meshing engagement therebetween, because the peripheral speed of the spherical gear 82', i.e., the velocity of movement of the teeth of the spherical gear 82' in the oscillating direction is small as compared with that in the arrangement shown in FIG. 16A.

Figure 16B:
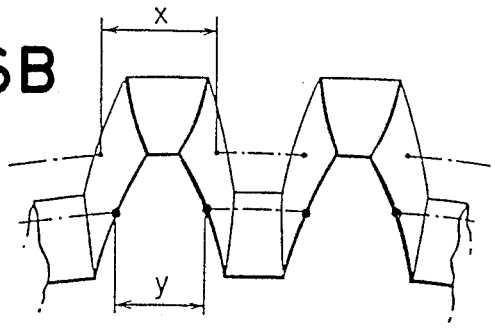
FIGS. 16B and 16C are a perspective view and a top plan view of the spherical gear, illustrating the shape of the teeth of the spherical gear.
Figure 16C:
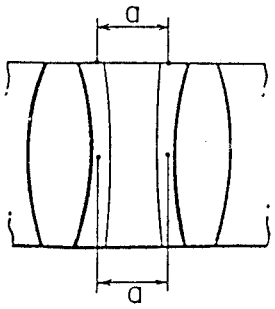
Figure 17B:
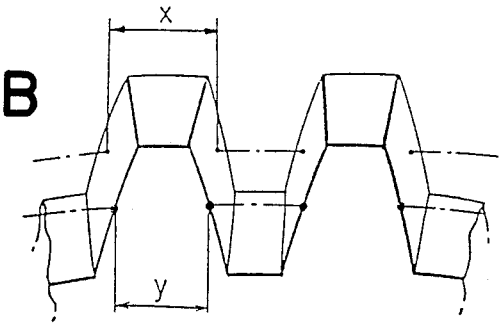
FIGS. 17B and 17C are a perspective view and a top plan view of the spherical gear, illustrating the shape of the teeth of the spherical gear shown in FIG. 16A.
Figure 17C:
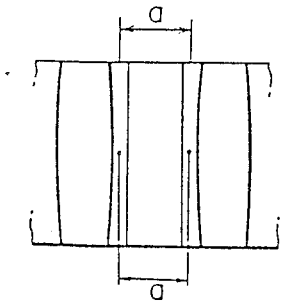

FIGS. 16B and 16C show the profile of the gear teeth of the spherical gear 82 shown in FIG. 16A, while FIGS. 17B and 17C show the profile of the gear teeth of the spherical gear 82' shown in FIG. 17A. The gear teeth are generated by a cutter which cuts the bottom of the teeth, so that it is assumed here that the gap a between the adjacent teeth is constant while the width of the teeth is variable. In such a case, the tooth thickness variation ratio (y/x) expressed in terms of the ratio of tooth thickness (x) on the pitch circle the minimal tooth thickness (y) on the pitch circle smaller in the gear teeth shown in FIGS. 17B, 17 than in the gear teeth shown in FIGS. 16B, 16C. the gear teeth shown in FIGS. 17B and 17C has a minimal tooth thickness and smaller difference the minimal thickness from the standard thickness (tooth on pitch circle at widthwise center of as compared with the gear teeth shown in FIGS. 16B and 16C. Thus, the thickness variation ratio is smaller in the arrangement shown in FIGS. 17B, 17C as compared with that of the gear teeth shown in FIGS. 16B and 16C. Therefore, in the case of the gear teeth shown in FIGS. 16B and 16C, the transmission of rotational movement during the oscillation about the center of the oscillation causes the thinner gear teeth portion of the spherical gear to engage with the gear teeth of the spur gear 80, failing to meet the requirement for constant-velocity rotation of the gears. Namely, the reduced tooth thickness impairs the state of meshing between the teeth of the spherical gear and the teeth of the spur gear 80 so as to make it impossible to attain smooth transmission of rotation and, hence, to attain the required high precision of the feeding length. In addition, the large variation of the teeth thickness inevitably increases the wear of the surfaces of the meshing gear teeth. In the arrangement shown in FIG. 17A, however, the thickness variation ratio of the gear teeth can be reduced by virtue of the offset of the axis of rotation of the gear from the center of oscillation, so that the abovedescribed problems encountered by the arrangement shown in FIG. 16A can be appreciably suppressed. It is to be noted also that the gear teeth in the arrangement shown in FIG. 16A have reduced thickness at the corners of the teeth so as to reduce the mechanical strength, whereas, the arrangement shown in FIG. 17A enables the gear to have a compact design with reduced gear teeth width, provided that the gears are generated in both cases under the same generating conditions.

As will be understood from the foregoing description, the material feeding apparatus in accordance with the present invention facilitates the design for optimizing the timing relation between the first gripper device and the second gripper device. The optimized timing relation will contributes to an enhancement of the speed of the feed of the material and to improvement in the precision of amount or length of feed.

Although the invention has been described through its specific terms, it is to be understood that the described embodiment and modifications are only illustrative and various changes and further modifications may be imparted thereto without departing from the scope of the invention which is limited solely by the appended claims.

What is claimed is:

1. An apparatus for converting an oscillatory motion to a linear sliding motion comprising:

a slide block provided for reciprocatory sliding movement along a linear path;

an oscillating shaft;

means for oscillatorily driving said shaft;

an oscillating arm adopted to oscillate about the axis of said oscillating shaft, said oscillating arm connecting said oscillating shaft to said slide block, said oscillating arm including:

an arm member having a longitudinal slot extending therethrough and a screw rod extending through said slot;

adjusting means provided on said oscillating arm for adjusting a sliding stroke of said slide block with respect to an angle of rotation of said oscillating shaft, and including:

an adjusting member screwed to said screw rod for sliding longitudinal movement within said slot;

a slider rotatably secured to said adjusting member and slidably engaging with another slot formed in said slide block, such that oscillatory motion of said oscillating arm causes sliding movement of said slider along said another slot whereby causing said reciprocatory sliding movement of said sliding block;

a rotary means accessible for rotation of said screw rod to effect through said adjusting member and said slider, adjustment of said sliding stroke of said slide block; and a counting and indicating means provided on said oscillating arm for counting and indicating an amount of sliding stroke of said slide block, said counting and indicating means including:

a counter including an input shaft;

a transmission means provided between said input shaft of said counter and said screw rod for transmitting an amount of adjustment of said sliding stroke of said slide block effected by said rotary means to said counter.

2. An apparatus according to claim 1 wherein said rotary means comprises a rotary knob fixed to the outer end of said screw rod.

3. An apparatus according to claim 1 wherein said counter is supported on said arm member.

4. An apparatus according to claim 3 wherein said transmission means includes a first pulley mounted on said input shaft and a second pulley mounted on an outer end of said screw rod; and a transmission belt between said first and second pulleys.

5. An apparatus according to claim 4 wherein said rotary means includes a rotary knob connected to a free end of said input shaft of said counter.

6. An apparatus according to claim 1 wherein said counter is mounted on a first supporting member provided on a portion of an apparatus housing; and wherein said transmission means includes:

a first pulley provided on said counter's input shaft and a second pulley provided on a first end of a first shaft rotatably mounted on said first supporting member, said first and second pulleys being interconnected by a transmission belt;

a second shaft mounted on said oscillating shaft and parallel with said oscillating arm member;

a first pair of meshing gears on a second end of said first shaft and a first end of said second shaft, and a second pair of meshing gears on the second end of said second shaft and on a free end of said screw rod.

7. An apparatus according to claim 6, wherein said first pair of gears includes a spherical gear on said first end of said second shaft and a spur gear on said second end of said first shaft, and wherein said spherical gear includes arcuately formed teeth adapted to be kept in engagement with the teeth of said spur gear during oscillatory motion of said spherical gear.

8. An apparatus according to claim 7, wherein a first distance is defined between the axis of oscillation of said oscillating shaft, corresponding to the center of oscillation of said spherical gear, and an axis of rotation of said spur gear on said first gear shaft and a second distance is defined between the axis of rotation of said spherical gear and axis of rotation of said spur gear.

9. An apparatus according to claim 8, wherein said first and second distance are equal.

10. An apparatus according to claim 8, wherein said first distance is smaller than said second distance, the width of said spherical gear is reduced and wherein at the same time a maximum angle of oscillation of said spherical gear is equal to that for the apparatus in which said first and second distances are equal.

11. An apparatus according to claim 10, wherein said spherical gear includes gears with substantially small tooth thickness variation ratio (y/x), wherein x is a central tooth thickness on the pitch circle and y is a minimal tooth thickness on the pitch circle.

12. An apparatus for converting an oscillatory motion to a linear sliding motion comprising:

a slide block provided for reciprocatory sliding movement along a linear path;

an oscillating shaft;

means for oscillatorily driving said shaft;

an oscillating arm adopted to oscillate about the axis of said oscillating shaft, said oscillating arm connecting said oscillating shaft to said slide block;

adjusting means provided on said oscillating arm for adjusting a sliding stroke of said slide block with respect to an angle of rotation of said oscillating shaft; and a counting and indicating means provided on said oscillating arm for counting and indicating an amount of sliding stroke of said slide block;

said counting and indicating means including:

a counter having an input shaft;

a transmission means provided between said input shaft of said counter and said adjusting means on said oscillating arm for transmitting to said counter an amount of adjustment of said sliding stroke of said slide block effected by said adjusting means.

13. An apparatus according to claim 12, wherein said oscillating arm includes means for receiving a screw rod for extending therethrough;

said screw rod having an adjusting member connected thereto for sliding longitudinal movement within said receiving means; and a slider rotatably secured to said adjusting member and slidably engaging with another receiving means formed in said slide block, such that oscillatory motion of said oscillating arm causes sliding movement of said slider along said another receiving means whereby causing said reciprocatory sliding movement of said sliding block.

14. An apparatus according to claim 13, further comprising:

a rotary means accessible for rotation of said screw rod to effect through said adjusting member and said slider, adjustment of said sliding stroke of said slide block.

* * * * *